US006375291B1

(12) United States Patent
Nam et al.

(10) Patent No.: US 6,375,291 B1
(45) Date of Patent: Apr. 23, 2002

(54) DOORHANDLE DEVICE FOR REFRIGERATOR

(75) Inventors: Jeong-Man Nam, Kwangju; Cha-Soo Yoon, Anyang, both of (KR)

(73) Assignee: Samsung Electronics Co., Ltd., Suwon (KR)

( * ) Notice: Subject to any disclaimer, the term of this patent is extended or adjusted under 35 U.S.C. 154(b) by 10 days.

(21) Appl. No.: 09/625,407

(22) Filed: Jul. 25, 2000

(30) Foreign Application Priority Data

Sep. 4, 1999 (KR) ..... 99-37523

(51) Int. Cl.[7] ..... A47B 96/04

(52) U.S. Cl. ..... 312/405; 16/412; 292/254; 292/DIG. 71

(58) Field of Search ..... 312/407, 405, 312/244, 222, 116, 138.1, 139, 319.9; 16/412; 292/254, DIG. 71; 49/278, 277, 276, 501; 62/440

(56) References Cited

U.S. PATENT DOCUMENTS 2,659,115 A * 11/1953 Anderson et al. ..... 49/277
2,929,650 A * 3/1960 Squire ..... 292/DIG. 71 X
4,590,710 A * 5/1986 Newland ..... 49/278 X
4,913,476 A * 4/1990 Cook ..... 292/196
5,412,839 A * 5/1995 McCollom ..... 312/405 X
5,622,416 A * 4/1997 Rainey et al. ..... 312/319.9
5,865,483 A * 2/1999 Dubravin ..... 292/254 X
5,906,423 A * 5/1999 Lyu ..... 312/405
5,908,228 A * 6/1999 Lee ..... 312/405
5,915,805 A * 6/1999 Lee ..... 312/405
6,019,447 A * 2/2000 Jackovin ..... 312/405
6,053,544 A * 4/2000 Alvring et al. .. 292/DIG. 71 X

FOREIGN PATENT DOCUMENTS

JP 10252547 9/1998

* cited by examiner

*Primary Examiner*—Peter M. Cuomo
*Assistant Examiner*—Hanh V. Tran
(74) *Attorney, Agent, or Firm*—Larson & Taylor, PLC

(57) ABSTRACT

A door handle device for a refrigerator enables the refrigerator door to be easily opened and makes transporting and storage of the refrigerator easier and more efficient. The door handle device includes upper and lower operating levers respectively mounted on the top and bottom surfaces of the door. A vertically disposed door handle is connected at opposite ends to the respective operating levers. Upper and lower supporting mechanisms, provided respectively on the top and bottom surfaces of the door, rotatably support the operating levers. The ends of each of the operating levers are located on opposite sides of the center line Y—Y of the associated lever so that a rotating moment is applied to the operating lever when the associated door is opened. Each operating lever includes two members and a connecting arrangement for the lever members which permits the door handle to be repositioned to a location adjacent to the refrigerator door so as to decrease the effective depth of the refrigerator.

10 Claims, 6 Drawing Sheets

DOORHANDLE DEVICE FOR REFRIGERATOR

BACKGROUND OF THE INVENTION

1. Field of the Invention

The present invention relates to refrigerators and, more particularly, to a door handle device for a refrigerator which permits the refrigerator door to be easily opened, and which provides advantages with respect to packaging, transferring and storage of a refrigerator that incorporates the handle device.

2. Description of the Prior Art

In general, a refrigerator is an appliance which is utilized to keep various foods in a fresh state by supplying cool air generated from an evaporator to food storing compartments. Recently, there has been an increasing demand for large-sized refrigerators with an expanded food storage space so as to make food shopping more convenient by reducing the number of shopping trips necessary to keep food on hand and enabling the shopper to take advantage of special sales and/or sales in bulk quantities.

Most domestic refrigerators of large size are of a side-by-side constructions wherein a vertical partition divides the cabinet forming the framework of the refrigerator lengthwise into refrigerating and freezing compartments. Accordingly, the doors which are mounted on the front of each compartment are also arranged in side by side relation. The doors are mounted on hinges which are disposed at the front corners of the cabinet.

In the refrigerators discussed above, door handles for opening the doors are attached to the outer surfaces of the doors, and gaskets for sealing the compartments from the outside air are provided on the inner surfaces of the doors. The gaskets are made of a rubber material and attached to the edge of the inner surface of each door which contacts the front surface of the cabinet. As a result, when the doors are closed, the gaskets maintain the front surface of the cabinet airtight so that the cool air in the compartments does not leak to the outside. The gaskets include permanent magnets which closely adhere or secure the doors to the front metal surface of the refrigerator cabinet.

During the operation of a refrigerator as described above, the air within the refrigerator is cooled and condensed by a heat-exchange with the evaporator, so that the pressure inside of the refrigerator is lower than that outside. Because of this, when the user pulls the door handle to open the door, a considerable force is required because of (1) the magnetic force of the magnets in the gaskets and (2) the force due to the pressure difference between the inside and outside of the refrigerator.

Furthermore, because, in general, the door handle of a refrigerator projects forwardly from the front of the door, the width (depth) of the refrigerator is increased by an amount corresponding to the projecting portion of the door handle. Therefore, the size of the packaging for the refrigerator is increased, and this increase in volume increases the cost of storing the refrigerator and of transporting the refrigerator from one location to another.

SUMMARY OF THE INVENTION

The present invention is connected with overcoming the problems discussed above, and in this regard, an object of the present invention is to provide a door handle device for a refrigerator which reduces the force resisting opening of the door so that the refrigerator door can be more easily opened.

Another object of the present invention is to provide a door handle device for a refrigerator in which the door handle can be repositioned so as to be disposed adjacent to the front surface of the door so that the packaging for the refrigerator during transport thereof can be reduced or simplified and the storage space required by the refrigerator is reduced.

In accordance with the invention, a refrigerator is provided which comprises a cabinet having an open front and including storage compartments therein, a plurality of doors pivotably mounted on the cabinet by hinges affixed to front corners of the cabinet, and a door handle device secured to each of the doors, each said door handle device comprising: upper and lower operating levers respectively mounted on top and bottom surfaces of the associated door, said levers each including a first end in contact with a front surface of the cabinet and a second end extending forwardly from the door; a vertically extending door handle having opposite ends connected to the second ends of the operating levers; and upper and lower supporting means, respectively disposed at the top and bottom surfaces of the door, for rotatably supporting the operating levers.

Preferably, the operating levers include a central portion and both ends of each of the operating levers are disposed on opposite sides of a line Y—Y extending longitudinally of the central portion of the operating levers, so that when an opening force is exerted on the door handle, a rotating moment is applied to each of the operating levers using each of the respective supporting means as a hinge point.

Advantageously, the device further comprises a roller mounted at the first end of each of the operating levers for contacting the cabinet such that when the door is open, the roller rolls along the front surface of the cabinet and exerts a force against the cabinet so as to facilitate opening of the door.

The upper supporting means comprises a receiving hole formed in the top surface of the door, a supporting member disposed in the receiving hole and including a shaft-accommodating portion for rotatably supporting the upper operating lever; an elastic member mounted at an outer peripheral part of the shaft-accommodating portion so as to exert a restoring force to the upper operating lever; and a connecting shaft extending through the upper operating lever and connected to the shaft-accommodating portion. The elastic member advantageously comprises a coil spring having a first end affixed to the operating lever and a second end affixed to the supporting member.

Each of the operating levers preferably comprises a first lever member which contacts the front surface of the cabinet at a first end of said lever member and is rotatably supported at a center portion thereof by said supporting means; a second lever member having a first end connected to said first lever member and a second end connected to the door handle; and connecting means for connecting the first and second lever members together. Advantageously, the connecting means comprises a tongue portion formed on the second end of the first lever member; a tongue receiving portion formed on the first end of the second lever member and receiving the tongue portion; first, second and third pin holes formed in the tongue portion; fourth and fifth pin holes formed in the tongue receiving portion; and connecting pins for connecting the tongue portion to the tongue receiving portion. Preferably, the first and second pin holes and the fourth and fifth pin holes are disposed approximately on a line Y—Y extending longitudinally of the central portion of the corresponding operating lever, and the third pin hole is located on one side of the tongue portion, in spaced relation to the first, second, fourth and fifth pin holes, so that the door handle is in a first, operative position when the fifth pin hole is aligned with the second pin hole and the door handle is in a second position when the fifth pin hole is aligned with the third pin hole.

In accordance with a further aspect of the invention, a refrigerator is provided which comprises a cabinet having a front opening defined, in part, by upper and lower front surfaces of the cabinet and including storage compartments therein, a door pivotably mounted on the cabinet for, when closed, closing off the front opening of the cabinet, and a door handle device secured to said door, said door handle device comprising: an upper operating lever mounted on a top surface of the door and including a first end in contact with said upper front surface of said cabinet and a second end extending outwardly from the door; a lower operating lever mounted on a bottom surface of the door and including a first end in contact with said upper front surface of said cabinet and a second end extending outwardly from the door; a vertically extending door handle having opposite ends connected to the second ends of said upper and lower operating levers; and upper and lower supporting means, disposed respectively at the top and bottom surfaces of the door, for rotatably supporting said upper and lower operating levers such that an opening force exerted on said handle causes rotation of said operating levers so that the first ends thereof exert a force on the upper and lower front surfaces of the cabinet to facilitate opening of the door.

In the preferred implementation of this aspect of the invention, the cabinet includes a further said front opening located side by side with respect to the first-mentioned front opening, and a further said door for, when closed, closing off said further front opening, the further door also including a further said door handle device, i.e., a door handle device as described above.

Further features and advantages of the present invention will be set forth in, or apparent from, the detailed description of preferred embodiments thereof which follows.

BRIEF DESCRIPTION OF THE DRAWINGS

As indicated above, further objects and advantages of the present invention will become apparent from the following description of a preferred embodiment of the invention, taken in conjunction with the attached drawings, in which.

DETAILED DESCRIPTION OF THE PREFERRED EMBODIMENT

A preferred embodiment of the present invention will now be described in detail with reference to the accompanying drawings.

Figure 1:
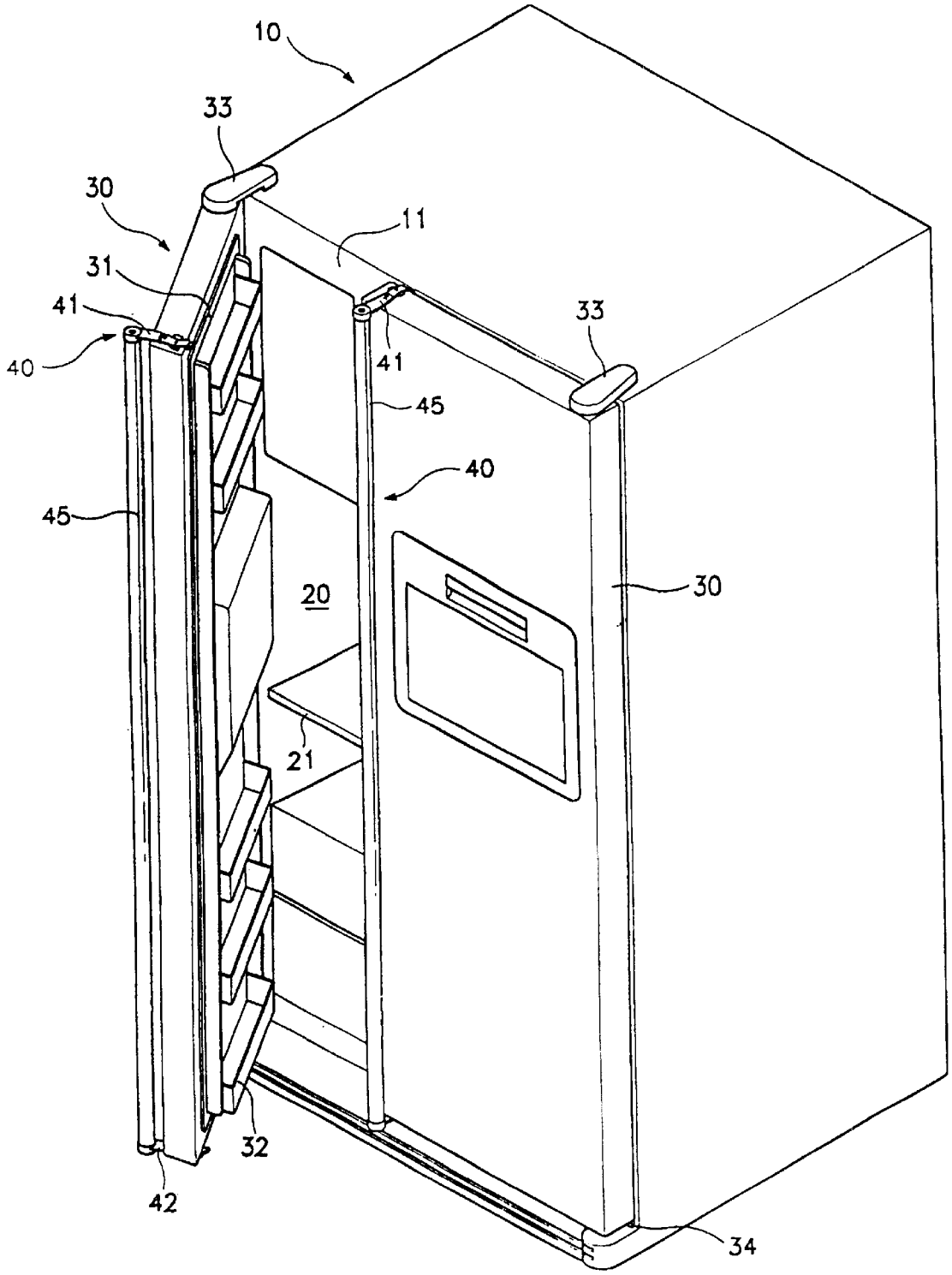
FIG. 1 is a perspective view of a refrigerator on which door handle devices according to this invention are mounted.

FIG. 1 illustrates a side-by-side type refrigerator which includes a cabinet 10 having food storing space therein, and a vertical partition which is arranged lengthwise in the cabinet 10 so as to define storage compartments 20 on the right and left sides. At the front of the storage compartments 20 are mounted left and right doors 30 for opening and closing the respective storage compartments 20. The front of the cabinet 10 on which the doors 30 are mounted is open so as to permit access to the storage compartments 20, and the storage compartments 20 have shelves 21 on which to put food.

Door handle devices 40 are mounted on the front of each of the doors 30 so as to permit the user to open the doors 30, and door shelves 32 are provided on the back of the doors 30 to store beverages. The doors 30 are pivotably or rotatably secured to the cabinet 10 by hinges 33,34 provided at the front corners of the cabinet 10. Gaskets 31 with magnets therein are attached to the edges of the inner surfaces of the doors 30 to seal the compartments 20 in an airtight manner when the doors 30 are closed. Each of the door handle devices 40 is disposed at the opposite side of the respective door 30 from the hinges 33,34 so that the door 30 is easily swung on the hinges 33,34.

Figure 2:
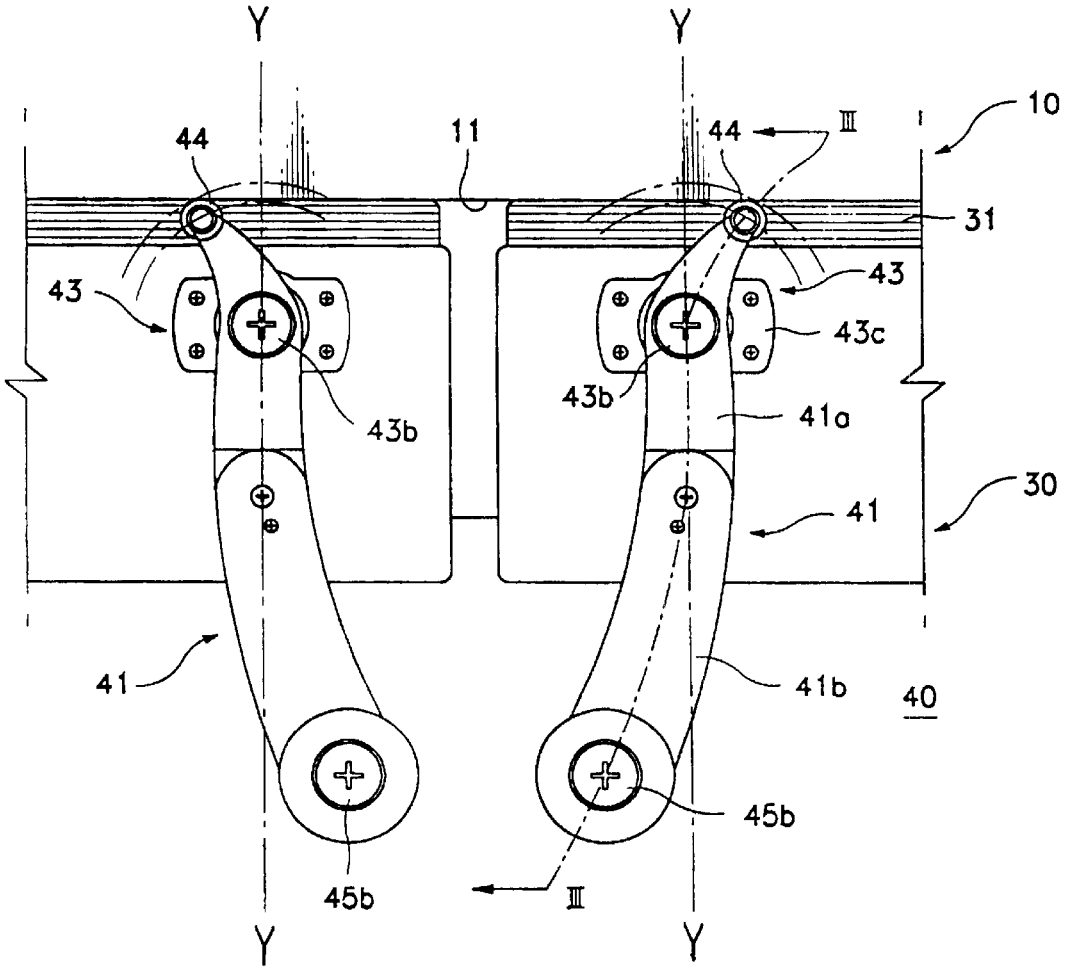
FIG. 2 is a plan view of the door handle devices according to this invention when the doors is in a closed state.

The specific construction of the door handle device 40 according to the present invention will now be described in detail with reference to FIGS. 2 to 4.

As illustrated, the door handle device 40 includes upper and lower operating levers 41 and 42 which are respectively disposed at the top and bottom of the door 30, upper and lower supporting means or mechanisms 43 for rotatably supporting the respective operating levers 41 and 42, and a door handle 45 which is arranged vertically and connected to the upper and lower operating levers 41 and 42 at opposite ends thereof.

The construction of the operating levers 41 and 42 will now be described. It is to be understood that the construction of the two operating levers 41 and 42 is identical, and, therefore, only the upper operating lever 41 will be described.

The upper operating lever 41 includes a first lever member 41*a* the front end of which, i.e., the free end thereof adjacent to the cabinet 10, is in contact with the front surface 11 of the cabinet 10 when the door 30 is closed, a second lever member 41*b* the front end of which, i.e., the end thereof closest to the cabinet 10, is connected to the first lever member 41*a* and the rear end of which is connected to the upper end of the door handle 45, and a connecting means or mechanism 46 for connecting the first lever member 41*a* and the second lever member 41*b* together. The operating lever 41 is formed in an approximately " " or shallow "S" shape, so that the front end of the first lever member 41*a* contacting the front surface 11 of the cabinet 10 is disposed on the opposite side from the rear end of the second lever member 41*b* relative to a line Y—Y (see, e.g., FIG. 2) which extends longitudinally of the center of the operating lever 41, i.e., extends along the longitudinal axis of a central portion of lever 41.

The first lever member 41*a* is also formed in an " " shape, so that both ends of the first lever member 41*a* are disposed on opposite sides on a supporting means or mechanism 43 which is provided at a center portion of the first lever member 41*a*.

With such a construction, when the door handle 45 is pulled, a rotating moment is applied to the first lever member 41*a*, with the supporting means 43 as a hinge point. A roller 44*a* of a flattened donut or annular shape is secured by a connecting pin 44*a* to the end of the first lever member 41*a* in contact with the front surface 11 of the cabinet 10.

Figure 3:
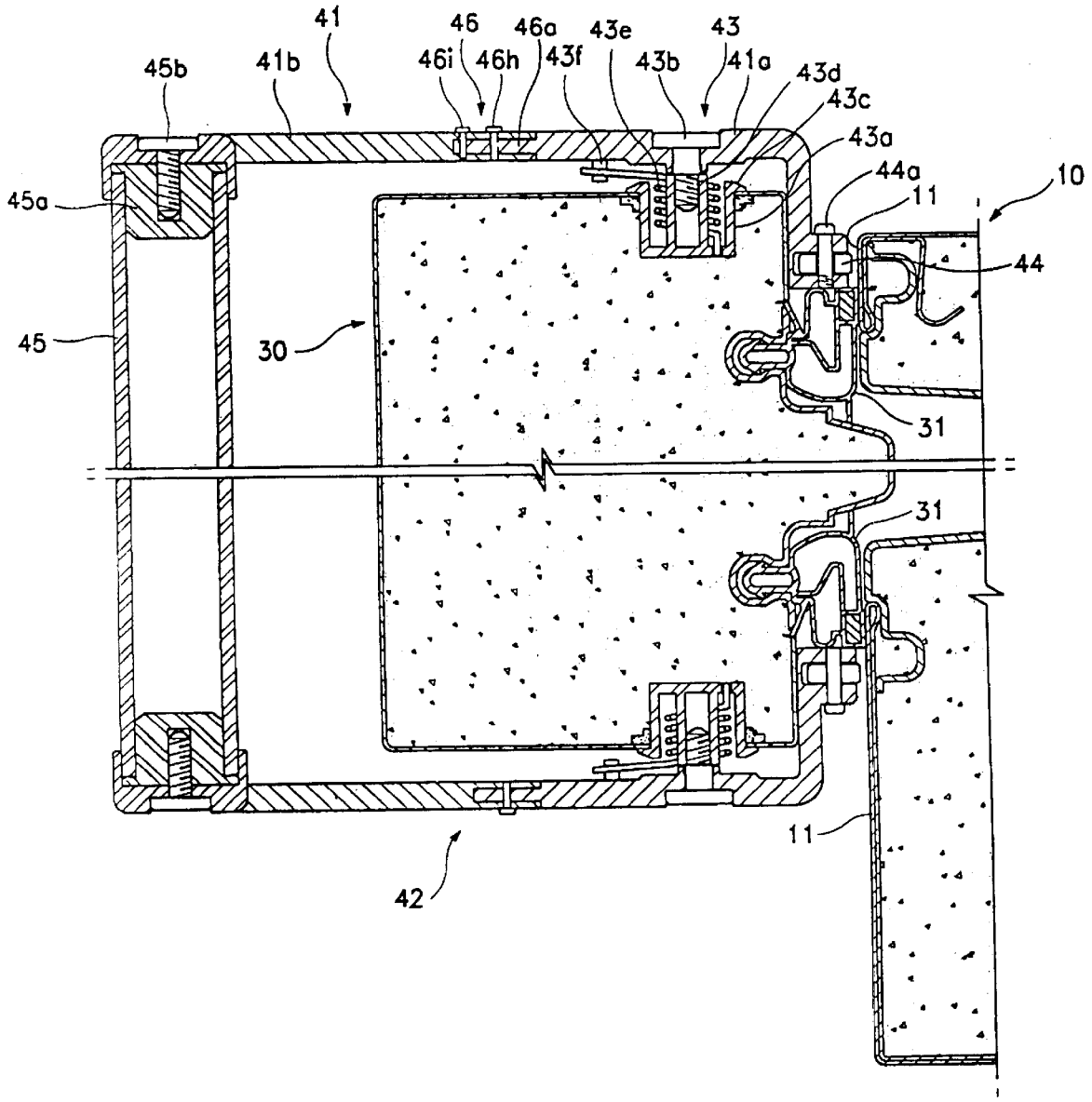
FIG. 3 is a sectional view taken along the line III—III of FIG. 2.
Figure 4:
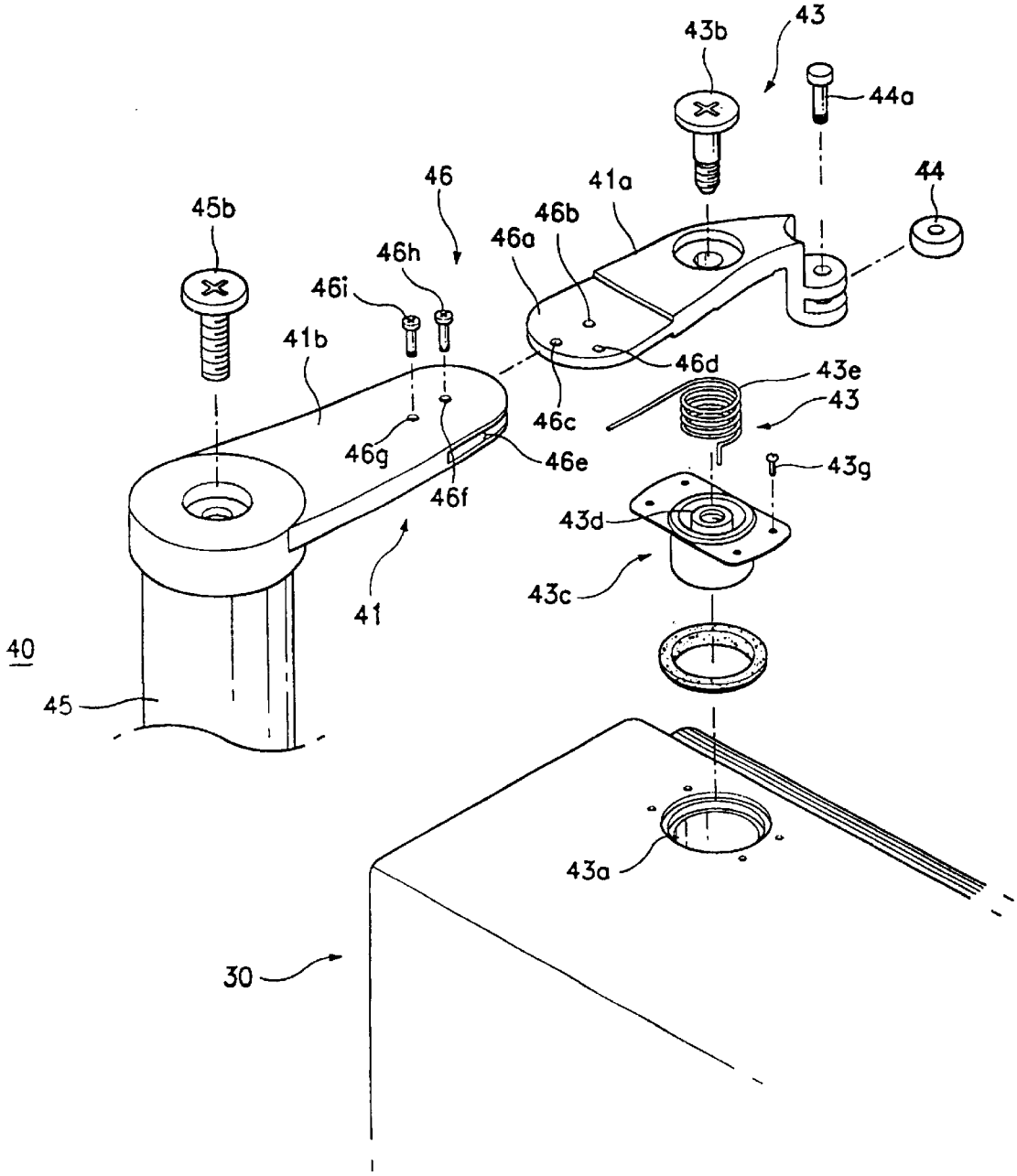
FIG. 4 is an exploded perspective view of the door handle device according to this invention.

As shown in FIGS. 3 and 4, the connecting means 46 includes an inserted portion or tongue portion 46*a* formed on the rear end of the first lever member 41*a*, a receiving portion or yoke portion 46*e* formed on the front end of the second lever member 41*b* for receiving the inserted portion 46*a*, first, second and third pin holes 46*b*, 46*c*, 46*d* formed in the inserted portion 46*a*, fourth and fifth pin holes 46*f*, 46*g* formed in the receiving portion 46*e*, and connecting pins 46*h*, 46*i* for connecting the inserted portion 46*a* to the receiving portion 46*e*.

As shown in FIG. 4, the inserted or tongue portion 46*a* has a semi-circular flat shape and is thinner than the remaining portion of the first lever member 41*a*. The receiving or yoke portion 46*e* forms a slot which is of a size that is a little larger than the thickness of the inserted portion 46*a* so as to receive the inserted portion 46*a* therein.

The first and second pin holes 46*b* and 46*c*, and the fourth and fifth pin holes 46*f* and 46*g* are disposed approximately on the line Y—Y which, as noted above, is the longitudinal center line of the operating lever 41, and the third pin hole 46*d* is disposed at a side of the inserted portion 46*a*, spaced away a given distance from the other pin holes. The connecting pins 46*h*, 46*i* are fitted to, i.e., received in, the corresponding pin holes, thereby connecting the first and second lever members 41*a* and 41*b* to each other.

The above-mentioned supporting means or mechanism 43 includes a receiving hole or aperture 43*a* formed at a location on the top surface of the door 30 corresponding to, i.e., in alignment with, a center portion of the first lever member 41*a*, a supporting member 43*c* of a cylindrical shape which is inserted into the receiving hole 43*a*, an elastic or resilient member 43*e* mounted in the supporting member 43*c*, and an connecting shaft 43*b* for rotatably connecting the first operating lever member 41*a* to the door 30.

At the top of the supporting member 43*c*, there is formed a flange portion extending outwardly in a horizontal direction and having a plurality of screw holes therein, so that the supporting member 43*c* is inserted into the receiving hole 43*a* and then fixed to the top of the door 30 by a plurality of screws 43*g*.

Inside the cylindrical supporting member 43*c*, there is provided a shaft-accommodating or shaft-receiving portion 43*d* which is concentric with the supporting member 43*c*. The connecting shaft 43*b* passes through the first lever member 41*a* and is inserted into the shaft-accommodating portion 43*d* so that the first lever member is rotatably connected to the supporting means 43. Further, the elastic member 43*e* is mounted at the outer periphery of the shaft-accommodating portion 43*d* so as to exert a returning or restoring force to the first lever member 41*a*. Elastic member 43*e* basically comprises a coil spring in the illustrated embodiment, and a lower downwardly projecting end of the elastic member 43*e* is affixed to the lower end of the supporting member 43*c*, and a laterally projecting upper end thereof is affixed to a projection 43*f* (see FIG. 3) which is formed on the inner surface of the first lever member 41*a*, thereby preventing removal of member 43*e*.

The door handle 45, which is of a tubular or pipe shape (see FIG. 3), has a bush 45*a* which is fitted to the top thereof. The door handle 45 is connected to the second lever member 41*b* by passing a screw 45*b* through the second lever member 41*b* so that screw 45*b* is affixed to the bush 45*a*.

The operation of the door handle device 40 will now be described in detail with reference to FIGS. 5 and 6.

First, in order to transport or transfer a refrigerator which incorporates the door handle devices according to this invention, i.e., to move the refrigerator from, e.g., a store at which the refrigerator has been purchased to the home of a purchaser, or from a factory to store, the tongue or inserted portion 46*a* of the connection mechanism 46 is inserted into the yoke or receiving portion 46*e*, and then the first pin hole 46*b* is aligned with the fourth pin hole 46*f* and the third pin hole 46*d* is aligned with the fifth pin hole 46*g* (see FIG. 4). At this stage, with the connecting pins 46*h* and 46*i* received in the respective pin holes, as shown in FIG. 6, the door handle 45 is disposed adjacent to the refrigerator door 30, in a transfer or transport position, thereby reducing the depth (front to back dimension) of the refrigerator. Accordingly, the packaging or carrying crate for the refrigerator can be decreased in size, so that it is possible to store a significantly increased number of products in a given space. Moreover, this decreased packaging size makes it more convenient to transport and install the refrigerator at the desired location at, e.g., the house of a purchaser.

Next, when the placement of the refrigerator is completed, i.e., when the refrigerator is installed at the location required by the purchaser, the connecting pin 46*i* is unfastened and then the second pin hole 46*c* is aligned with the fifth hole 46*g*, and the connecting pin 46*h* is fastened to, i.e., inserted into, the first pin hole 46*b* and fourth pin hole 46*f*. At this stage, when the connecting pin 46*i* is re-fastened to the second pin hole 46*c* and fifth pin hole 46*g*, the door handle 45 is disposed in a vertical orientation with respect to the refrigerator door 30, i.e., in a use position, illustrated, e.g., in FIG. 2.

The operation of the door handle device 40 when the door 30 is open will now be described.

When the door 30 is closed, the magnet-containing gasket 31, which, as noted above, is attached to the edge of the inner surface of the door 30, maintains the front surface 11 of the cabinet 10 airtight relative to the outside, or ambient surroundings, i.e., seals the front surface 11 from the entry of air. Further, when the door 30 is opened, relatively high temperature outside air enters the inside of the refrigerator, and the entering air is cooled through the evaporator, so that the inside of the refrigerator is kept at a lower pressure than that outside.

Figure 5:
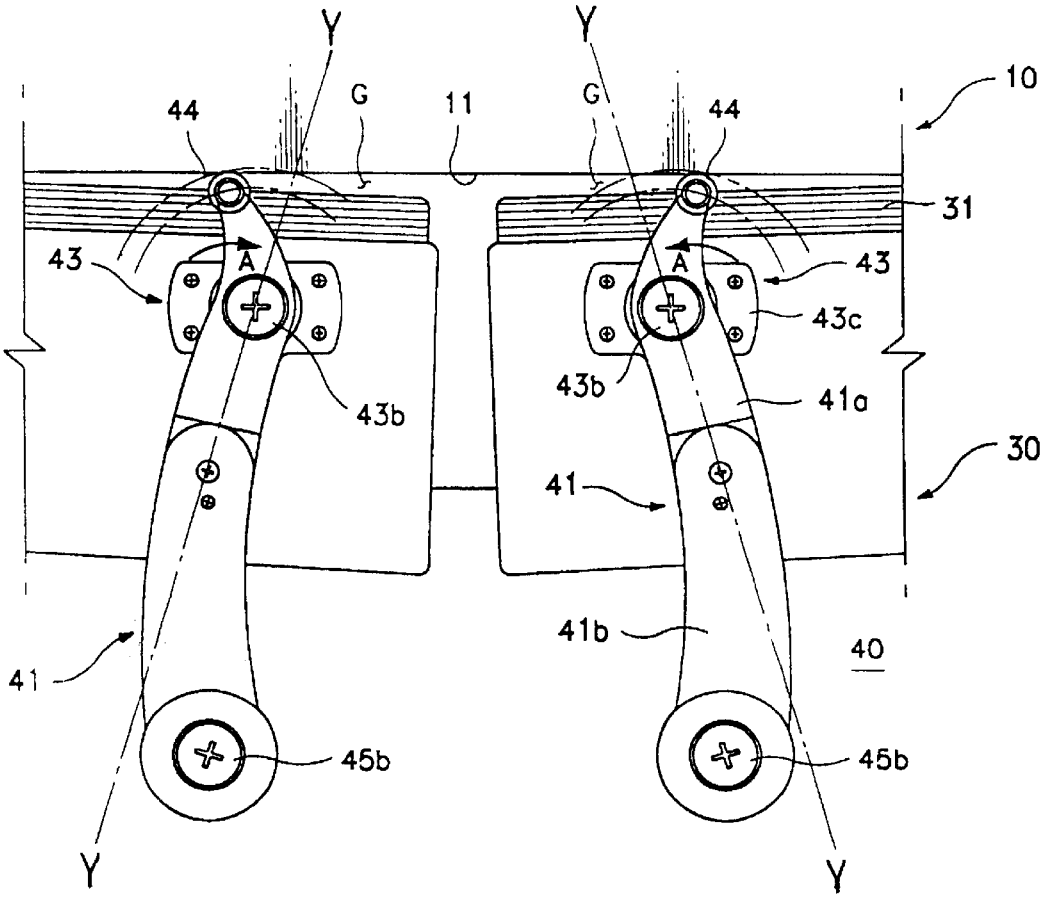
FIG. 5 is a plan view of the door handle devices according to this invention when the doors are just opening.
Figure 6:
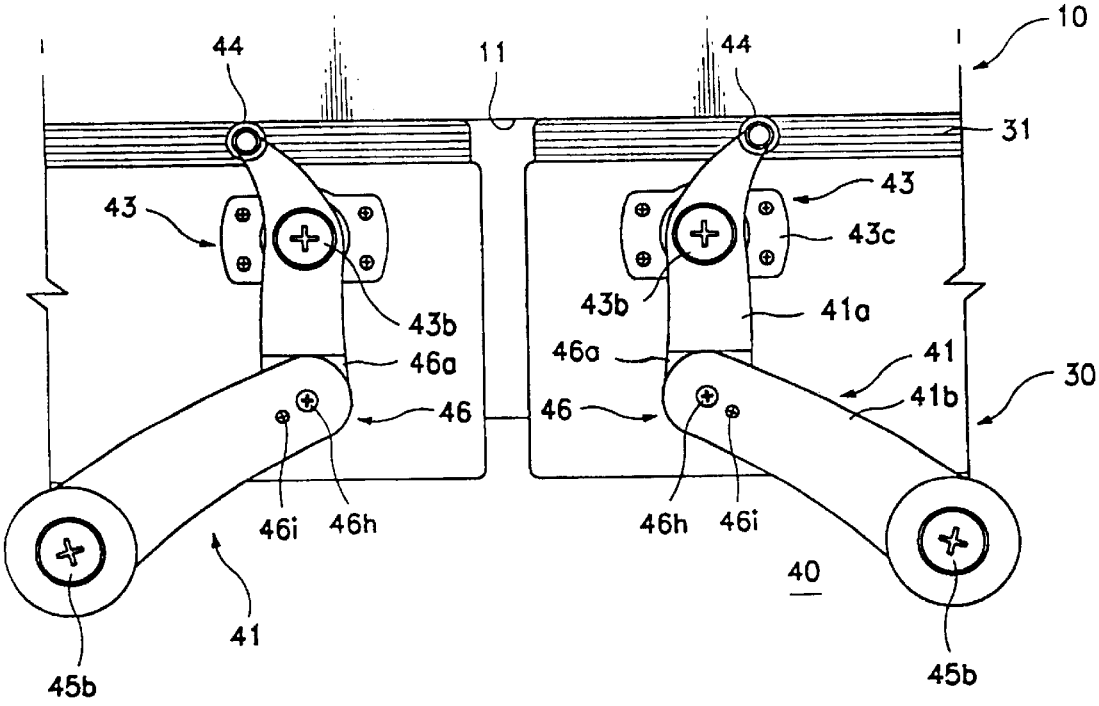
FIG. 6 is a plan view of the door handle devices according to this invention when the door handles are folded to transfer the refrigerator.

Under these conditions, as shown in FIG. 5, if a user pulls the door handle 45 to open the door 30, because both the ends of the operating lever 41, namely the rear or distal end of the second lever member 41*b*, which is connected to the door handle 45, and the front or proximal end of the first lever member 41*a*, which is in contact with the cabinet 10, are disposed on opposite sides of the line Y—Y, a rotating moment, in the direction of arrow A, around the connecting shaft 43*b*, is applied to the first lever member 41*a*.

As a consequence of the resultant rotation of the first lever member 41*a*, the roller 44, which is fitted or affixed to the front end of the first lever member 41*a*, rolls along the front surface 11. By virtue of the separating force exerted by the roller 44, a portion of the gasket 31 adjacent to the operating levers 41,42 is initially separated from the cabinet 10 and a gap, indicated at G, is formed. As a result, outside air is introduced into the storage compartment 20, and therefore, the storage compartment 20 is, for an instant, charged to a pressure equal to that of the outside. As a result, there is no pressure difference between the inside and the outside of the refrigerator, thus facilitating opening of the door 30.

During this rotation of the first lever member 41*a*, the elastic member of the supporting means 43, i.e., the coil spring 43*e*, is compressed. At this stage, if the user releases the door handle 45, the operating levers 41,42 and door handle 45 are returned back to the original positions by the elastic force of the coil spring 43*e*. If the door 30 is closed, the gasket 31 with the magnets therein maintains the front surface of the cabinet 10 airtight so that the cool air in the compartment 20 does not leak out to the outside.

As will be evident from the foregoing, the door handle device according to this invention has the advantage that the door can be easily and smoothly opened, because opening of the door is carried out after the internal pressure within the refrigerator is made to equal the ambient or outside pressure. Further, the door handle device according to this invention has the further advantage in that the transporting and storage of the associated refrigerator is easier, and the transporting and storage costs can be reduced, because the door handle can be repositioned so as to be disposed adjacent to the front surface of the door thus reducing the profile of the refrigerator.

Although the invention has been described above in relation to preferred embodiments thereof, it will be understood by those skilled in the art that variations and modifications can be effected in these preferred embodiments without departing from the scope and spirit of the invention.

What is claimed is:

1. A refrigerator comprising a cabinet having an open front and including storage compartments therein, a plurality of doors pivotably mounted on the cabinet by hinges affixed to front corners of the cabinet, and a door handle device secured to each of the doors, each said door handle device comprising:

upper and lower operating levers respectively mounted on top and bottom surfaces of the associated door, said levers each including a first end in contact with a front surface of the cabinet and a second end extending forwardly from the door;

a vertically extending door handle having opposite ends connected to the second ends of the operating levers; and upper and lower supporting means, respectively disposed at the top and bottom surfaces of the door, for rotatably supporting the operating levers, the upper supporting means comprising a receiving hole formed in the top surface of the door and having a shaft-accommodating portion therein for rotatably supporting the upper operating lever; an elastic member mounted at an outer peripheral part of the shaft-accommodating portion so as to exert a restoring force to the upper operating lever; and a connecting shaft extending through the upper operating lever and fitted to the shaft-accommodating portion.

2. The door handle device for a refrigerator according to claim 1, wherein said operating levers include a central portion and both ends of each of the operating levers are disposed on opposite sides of a line Y—Y extending longitudinally of the central portion of the operating levers, so that when an opening force is exerted on the door handle, a rotating moment is applied to each of the operating levers using each of the respective supporting means as a hinge point.

3. The door handle device for a refrigerator according to claim 1, further comprising a roller mounted at the first end of each of the operating levers for contacting the cabinet such that when the door is open, the roller rolls along the front surface of the cabinet and exerts a force against the cabinet so as to facilitate opening of the door.

4. The door handle device for a refrigerator according to claim 1, wherein the elastic member comprises a coil spring having one end affixed to the operating lever.

5. The door handle device for a refrigerator according to claim 1, wherein each of the operating levers comprises a first lever member which contacts the front surface of the cabinet at a first end of said lever member and is rotatably supported at a center portion thereof by said supporting means; a second lever member having a first end connected to said first lever member and a second end connected to the door handle; and connecting means for connecting the first and second lever members together.

6. The door handle device for a refrigerator according to claim 5, wherein said connecting means comprises a tongue portion formed on the second end of the first lever member; a tongue receiving portion formed on the first end of the second lever member and receiving the tongue portion; first, second and third pin holes formed in the tongue portion; fourth and fifth pin holes formed in the tongue receiving portion; and connecting pins for connecting the tongue portion to the tongue receiving portion.

7. The door handle device for a refrigerator according to claim 6, wherein the first and second pin holes and the fourth and fifth pin holes are disposed approximately on a line Y—Y extending longitudinally of the central portion of the corresponding operating lever, and the third pin hole is located on one side of the tongue portion, in spaced relation to the first, second, fourth and fifth pin holes, so that the door handle is in a first, operative position when the fifth pin hole is aligned with the second pin hole and the door handle is in a second position when the fifth pin hole is aligned with the third pin hole.

8. A refrigerator comprising a cabinet having a front opening defined, in part, by upper and lower front surfaces of the cabinet and including storage compartments therein, a door pivotably mounted on the cabinet for, when closed, closing off the front opening of the cabinet, and a door handle device secured to said door, said door handle device comprising:

an upper operating lever mounted on a top surface of the door and including a first end in contact with said upper front surface of said cabinet and a second end extending outwardly from the door;

a lower operating lever mounted on a bottom surface of the door and including a first end in contact with said upper front surface of said cabinet and a second end extending outwardly from the door;

a vertically extending door handle having opposite ends connected to the second ends of said upper and lower operating levers; and upper and lower supporting means, disposed respectively at the top and bottom surfaces of the door, for rotatably supporting said upper and lower operating levers such that an opening force exerted on said handle causes rotation of said operating levers so that the first ends thereof exert a force on the upper and lower front surfaces of the cabinet to facilitate opening of the door, the upper supporting means comprising a receiving hole formed in the top surface of the door and having a shaft-accommodating portion therein for rotatably supporting the upper operating lever; an elastic member mounted at an outer peripheral part of the shaft-accommodating portion so as to exert a restoring force to the upper operating lever; and a connecting shaft extending through the upper operating lever and fitted to the shaft-accommodating portion.

9. A refrigerator according to claim 8 wherein said cabinet includes a further said front opening located side by side with respect to the first-mentioned front opening and a further said door for, when closed, closing off said further front opening, said further door also including a further said door handle device.

10. The door handle device for a refrigerator according to claim 8, wherein the elastic member comprises a coil spring having one end affixed to the operating lever.

* * * * *